US009388500B2

(12) United States Patent
Yurkov et al.

(10) Patent No.: US 9,388,500 B2
(45) Date of Patent: Jul. 12, 2016

(54) DEVICE FOR THE DOSED FEEDING OF RAW MATERIAL INTO AN ALUMINIUM REDUCTION CELL

(75) Inventors: Vladimir Viktorovich Yurkov, Krasnoyarsk (RU); Aleksandr Olegovich Gusev, Krasnoyarsk (RU); Vladimir Petrovich Batorshin, Krasnoyarsk (RU); Aleksandr Mikhaylovich Petrov, Krasnoyarsk (RU)

(73) Assignee: United Company RUSAL Engineering and Technology Centre, LLC, Krasnoyarsk (RU)

( * ) Notice: Subject to any disclaimer, the term of this patent is extended or adjusted under 35 U.S.C. 154(b) by 0 days.

(21) Appl. No.: 14/414,280

(22) PCT Filed: Jul. 12, 2012

(86) PCT No.: PCT/RU2012/000564
§ 371 (c)(1),
(2), (4) Date: Jan. 12, 2015

(87) PCT Pub. No.: WO2014/011073

PCT Pub. Date: Jan. 16, 2014

(65) Prior Publication Data

US 2015/0191839 A1 Jul. 9, 2015

(51) Int. Cl.
*C25C 3/14* (2006.01)

(52) U.S. Cl.
CPC ..... *C25C 3/14* (2013.01)

(58) Field of Classification Search
USPC ..... 222/424.5, 425, 450, 451, 453
See application file for complete search history.

(56) References Cited

U.S. PATENT DOCUMENTS

| | | | | |
|---|---|---|---|---|
| 576,241 | A * | 2/1897 | Van Ame | G01F 11/18 222/135 |
| 1,037,794 | A * | 9/1912 | Newton | G01F 11/24 119/70 |
| 2,054,881 | A * | 9/1936 | Saunders | G01F 11/003 222/181.1 |
| 2,864,538 | A * | 12/1958 | Rasmussen | G01F 11/12 222/307 |
| 4,437,964 | A | 3/1984 | Gerphagnon et al. | |
| 5,423,968 | A | 6/1995 | Kissane | |
| 7,497,359 | B2 * | 3/2009 | Bergin | G01F 11/32 222/153.01 |

FOREIGN PATENT DOCUMENTS

| | | |
|---|---|---|
| CN | 1884627 | 12/2006 |
| CN | 202107780 | 1/2012 |
| RU | 2251592 | 5/2005 |
| RU | 2315823 | 1/2008 |
| RU | 2321685 | 4/2008 |

* cited by examiner

*Primary Examiner* — Donnell Long
(74) *Attorney, Agent, or Firm* — Hogan Lovells US LLP

(57) ABSTRACT

The invention relates to a device for the metered feeding of stock into an aluminum electrolyzer. The device comprises a hopper for the material to be metered, a metering chamber with a rod having a pneumatic drive, an upper shut-off element which is rigidly fixed on the rod in the upper part of the metering chamber and is in the form of a valve, a lower shut-off element which is fixed on the end of the rod and is in the form of a cone valve with a conical cover, and charging apertures which are arranged around the perimeter in the upper part of the dosing chamber above the base of the hopper. The upper limits of the charging apertures are arranged above the upper position of the valve, and the distance from the base of the cone valve to the lower section of the metering chamber in an upper position of the rod is not less than the distance from the lower surface of the upper shut-off element to the lower limit of the charging apertures. An increase in the reliability of the device and in the metering accuracy is ensured, and, accordingly, the technological characteristics of the operation of the electrolyzer are improved.

1 Claim, 2 Drawing Sheets

DEVICE FOR THE DOSED FEEDING OF RAW MATERIAL INTO AN ALUMINIUM REDUCTION CELL

Figure 1:
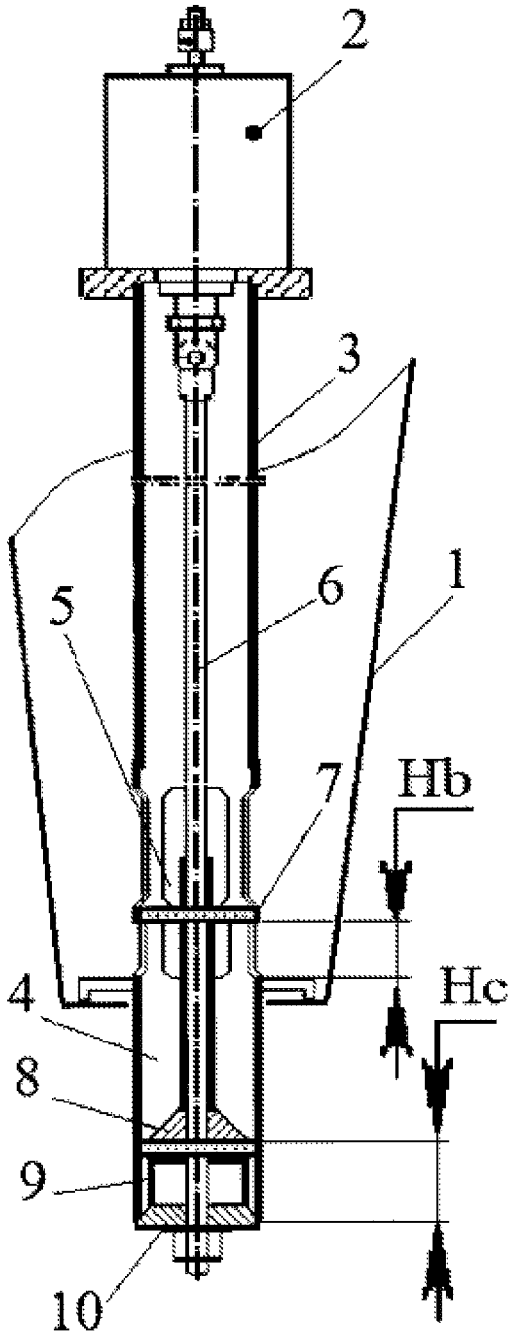

This application is a U.S. National Phase under 35 U.S.C. §371 of International Application PCT/RU2012/000564, filed on Jul. 12, 2012. All publications, patents, patent applications, databases and other references cited in this application, all related applications referenced herein, and all references cited therein, are incorporated by reference in their entirety as if restated here in full and as if each individual publication, patent, patent application, database or other reference were specifically and individually indicated to be incorporated by reference.

The invention relates to non-ferrous metallurgy, in particular, to the electrolytic reduction of aluminum. More specifically, it relates to devices for feeding raw material into a cell and can be used for feeding alumina, aluminum fluoride, and crushed bath into a reduction cell.

A device is known for feeding raw materials into an aluminum reduction cell (U.S. Pat. No. 4,437,964, 1984, C25C 3/14) which includes a vertically installed pneumatic cylinder, a dosing hopper, and a protective casing separating the mechanisms of the feeder from the raw material. The volumetric feeder comprises a dosing chamber, a rod which is actuated by the pneumatic cylinder and two closing elements in the form of cone valves rigidly fixed on the rod, whereby the vertex of the cone of the upper valve is directed downwards, and the vertex of the cone of the lower valve is directed upwards. The dosing chamber is placed under an aperture in the lower part of the protective casing of the feeder, through which the rod of the pneumatic cylinder passes. The dosing chamber is fixed to the protective casing of the feeder by means of a plurality of fins, with a wide space between the fins. When the rod is in the raised position, the upper valve is open to be accessed with raw material, and the lower valve closes the bottom of the dosing chamber. Due to gravitational forces, the dosed material then penetrates between the fins and fills the dosing chamber. When the rod moves down, both cone valves also drop down, and, moreover, the upper valve closes the upper part of the dosing chamber and the lower valve moves downwards from the lower edge of the chamber, thus allowing a dose of material
to be fed by a distributing chute to a hole in the bath crust made by a breaker.

The disadvantages of the above analogous solution are as follows:

1. When the rod moves from the raised position to the lower position, the lower valve is already open for dumping material from the chamber, and the upper valve is still not closed. This makes it possible to add new portions of raw material to the chamber. Different conditions (rod movement speed, moisture of dosed material, etc.) can cause theses additional portions of raw material to be different. Thus, the dose of raw material is not constant.

2. Due to the unfavorable environment and considerable loads on the rod, it may be deformed. Deformation of the rod, on which the valves are rigidly mounted, can sometimes lead to the deformation of the valves and the end surfaces of the dosing chamber, consequently, to material dumping even when the valves are closed.

The closest to the claimed device in terms of its technical essence and technical effect is a device for the dosed feeding of raw material into an aluminum reduction cell (RF Patent No. 2,315,823 C25C 3/14, 2008). The device has a dosing hopper, a dosing chamber with a rod and pneumatic cylinder. Lower and upper closing elements are rigidly fixed on the rod;

the upper closing element is in the form of a piston. The lower closing element is fixed at one end of the rod and is in the form of a cone valve, to which a lower piston is connected. In the upper part of the dosing chamber, above the bottom of the hopper, charging ports are located along the perimeter, so that the upper piston is above the charging ports when the rod is in the raised position. The distance from the bottom of the cone valve to the lower section of the dosing chamber is not less than the height of the charging ports. A cone cover is attached to the rod through
a universal joint, which makes possible gentle self-aligning on the lower section of the dosing chamber. The cone cover serves to fix the rod in the raised position, to protect the lower piston from hot and corrosive gases coming from the surface of the bath and to prevent spillages of dosed material that penetrates through the gap between the lower piston and the inner surface of the dosing chamber. The device provides a stable dose by means of a significant decrease in the dependence of the dose of raw material on the physical characteristics of the raw material and the movement speed of the rod of the pneumatic cylinder.

One of the disadvantages related to this device is the high cost of the feeder due to the complexity of the manufacturing and the low reliability of the universal joint in the abrasive medium. Another disadvantage is that a certain amount of alumina can leak on the cone cover through the gap between the lower piston and the inner surface of the dosing chamber. There is also a potential for raw material pelletization that can take place near the charging ports due to lack of agitation of the material. Both factors worsen the accuracy of the dosing.

The aim of the invention is to develop a device for the dosed feeding of raw materials into a reduction cell, whose design, compared to the prior art, not only provides a stable dose of the raw material, which is the case for the prior art, but also operates more accurately and is more reliable and costs and weighs less.

The above aim is achieved in that the device for the dosed feeding of raw material to the reduction cell, which includes a dosing hopper and a dosing chamber containing a rod with a pneumatic drive, has rigidly fixed on the rod an upper closing element in the upper part of the dosing chamber, a lower closing element fixed at one end of the rod and being in the form of a cone valve with a cone cover, and charging ports located along
the perimeter in the upper part of the dosing chamber above the bottom of the hopper. According to the proposed invention, the upper closing element is in the form of a valve and located on the rod so that the upper surface of the valve, when the rod is in its initial position, is lower than the upper margin of the charging ports; and in the lower closing element, the cone valve is connected to the cone cover through the piston, while the distance from the bottom of the cone valve to the lower section of the dosing chamber, when the rod is in the raised position, is not less than the distance from the lower surface of the upper closing element to the lower margin of the charging ports.

The first distinctive feature is the replacement of the upper piston, moving in the dosing chamber, by a valve, which leads to a relative increase in the height of the charging ports. As opposed to the prior art, the charging ports are located so that the upper margin of the charging port is higher than the upper surface of the valve, and the valve itself is always under the layer of alumina. When the rod moves, the valve agitates the alumina in the area of the charging ports. As a result, the number of alumina lumps, which potentially can limit alumina loading into the dosing chamber through the charging ports, decreases. Moreover, a valve is considerably lighter and cheaper than a piston.

The other distinctive feature of the invention is the use of a cone valve, rigidly fixed on the rod, as a lower closing element, a piston and a cone cover, instead of a cone valve, a universal joint and a cone cover. This design makes the device simpler and cheaper, makes it more reliable, and also prevents alumina accumulation between the cone valve and the cover, which further increases the accuracy of the dose of alumina.

The essence of the invention is clarified with the following figures:

FIG. 1 shows the device for the dosed feeding of raw material into an aluminum reduction cell.

Figure 2:
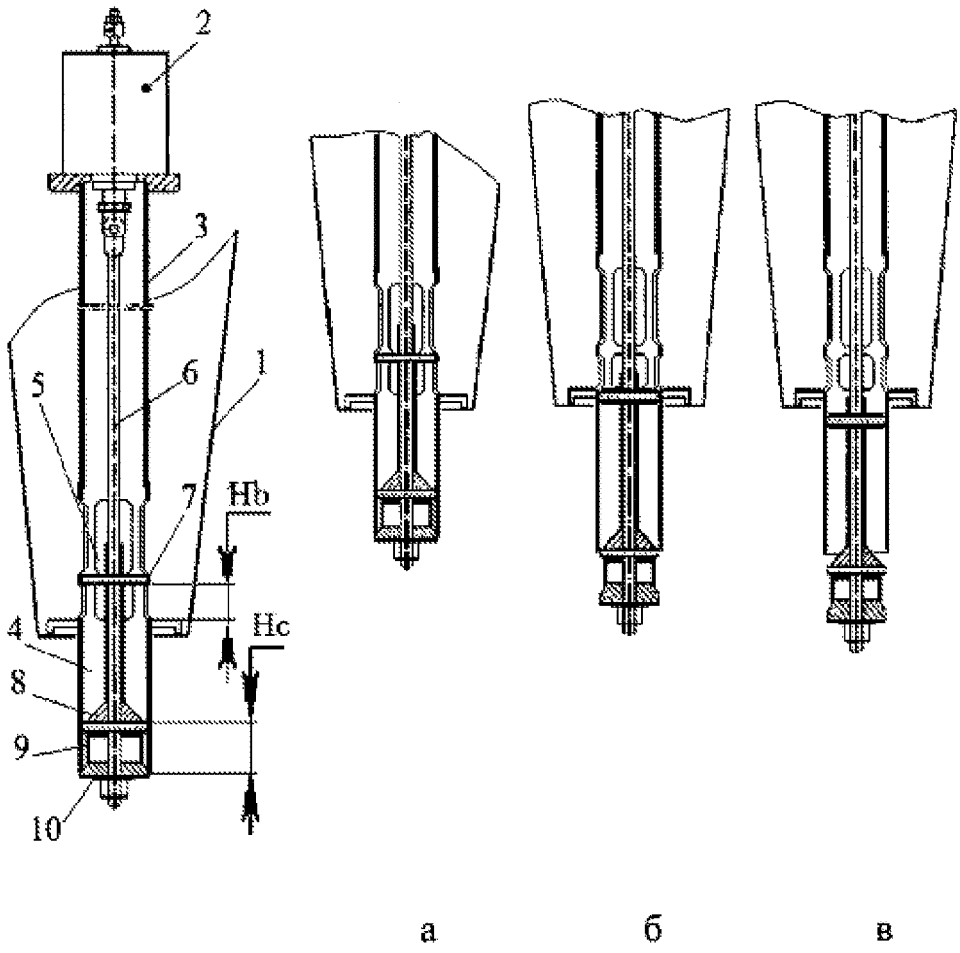

FIG. 2*a* shows loading, the rod being is in the raised, initial position. FIG. 2*b* shows the rod in the middle position. FIG. 2*c* shows unloading, the rod being is in the lower position.

The device for dosing of raw material includes dosing hopper 1, pneumatic cylinder 2 and dosing chamber 3. Lower part 4 of dosing chamber 3 is under charging ports 5, below the aperture in the bottom of hopper 1. The upper part of dosing chamber 3, including charging ports 5, is located in hopper 1. Inside the dosing chamber passes rod 6, actuated by pneumatic cylinder 2. Valve 7 is mounted on rod 6. The upper surface of valve 7, when rod 6 is in the raised position, is lower than the upper margin of charging port 5. Cone valve 8 and piston 9 connected to its, which are both fixed on rod 6, function as a lower closing element. Cone cover 10 made of thermal resistant materials is connected to the lower end of rod 6 through piston 9.

Connection of cone cover 10 to rod 6 through cone valve 8 and piston 9 makes it possible for the cone cover to align itself relative to the axis of the dosing chamber and the chamfer of the lower section of dosing chamber 4.

The device for the dosed feeding of raw material functions as follows.

Dosed material constantly fills the space in the area of charging port 5 of dosing chamber 3. In the initial position, rod 6 is in the raised position, valve 7 is lower than the upper margin of charging ports 5, the discharge aperture in lower part 4 of the dosing chamber is closed with cone cover 10, cone valve 8 with lower piston 9 are in the maximum possible raised position above the discharge aperture of the dosing chamber. The distance from the bottom of cone valve 8 (where this valve contacts lower piston 9)
to the lower section of the dosing chamber (Hc) of the feeder is not less than the height (Hb) between the lower margin of the charging ports and the lower surface of the valve. Dosed material from hopper 1 fills lower part 4 of the dosing chamber through charging ports 5. For unloading of dosing chamber 4, a control signal is sent to pneumatic cylinder 2, which actuates rod 6 to move down, along with valve 7, cone valve 8 with piston 9 connected to it and cone cover 10. The channel under charging ports 5 to lower part 4 of the dosing chamber is closed by valve 7, and raw material pours into a hole in the alumina-bath crust through the discharge aperture in lower part 4 of the dosing chamber and then by gravity. The bottom of cone valve 8 with piston 9 connected to it passes the lower section of dosing chamber 4 at the moment when the channel under charging ports 5 is fully closed by valve 7. In this case, there is no pass-through for raw material from hopper 1, through dosing chamber 4 and through the discharge aperture, to the bath. The rod stroke length was determined by experiment in such a way that cone valve 8 had to provide full evacuation of raw material from the dosing chamber with downward movement of the rod with cone valve 8. After evacuation of dosing chamber 4, rod 6 starts to return up to the initial position. Along with this, the bottom of cone valve 8 reaches the discharge aperture of the dosing chamber before the channel for raw material under charging ports 5 opens. Then, as rod 6 nears its raised position, cone cover 10, aligned by cone valve 8 and piston 9, accurately settles on the chamfer of the lower section of the dosing chamber, which prevents deformation of the cover itself and the contacting surface of the feeder. The cone cover serves to fix rod 6 in the raised position, to protect piston 9 and the inner surface of dosing chamber 4 from hot corrosive
gases coming from the surface of the bath, and also, together with piston 9, to prevent spillages of dosed material through the gap between cone valve 8 and the inner surface of dosing chamber 4.

Thus, use of the proposed invention provides a higher reliability of the device and a higher accuracy of dosing, which in turn improves the technological process parameters of the cell.

The invention claimed is:

1. A device for dosed feeding of raw material into an aluminum reduction cell comprising:

a dosing hopper having a top and bottom;

a dosing chamber having a rod with a pneumatic drive, which is rigidly fixed on the rod; wherein the dosing chamber has an upper section and lower section, each having a perimeter;

an upper closing element in the upper section of the dosing chamber; wherein the upper closing element has an upper surface and a lower surface;

a lower closing element fixed at one end of the rod and being in the form of a cone valve with a cone cover; wherein the cone valve has a top and a bottom; and charging ports located along the perimeter in the upper part of the dosing chamber above the bottom of the hopper; wherein the charging ports have an upper margin and a lower margin;

wherein the upper closing element is in the form of a valve having an upper and lower surface; and is located on the rod, so that the upper surface of the valve, when the rod is in its initial position, is lower than the upper margin of the charging ports; and wherein in the lower closing element, the cone valve is connected to the cone cover through a piston, while a distance between the bottom of the cone valve and the lower section of the dosing chamber, when the rod is in a raised position, is not less than a distance from the lower surface of the upper closing element to the lower margin of the charging ports.

* * * * *